United States Patent [19]

Buehler

[11] Patent Number: 4,614,437

[45] Date of Patent: Sep. 30, 1986

[54] MIXING CONTAINER AND ADAPTER

[75] Inventor: John D. Buehler, Bridgeton, N.J.

[73] Assignee: Dougherty Brothers Company, Buena, N.J.

[21] Appl. No.: 667,656

[22] Filed: Nov. 2, 1984

[51] Int. Cl.[4] ..... B01F 5/06

[52] U.S. Cl. ..... 366/130; 215/6; 215/250; 215/100.5; 220/277; 604/414; 604/88

[58] Field of Search ..... 366/130, 129, 348, 349, 366/341; 220/212, 277; 206/508; 215/6, 250, 100.5; 604/411, 414, 87, 88

[56] References Cited

U.S. PATENT DOCUMENTS

| | | | |
|---|---|---|---|
| 2,849,156 | 8/1958 | Mansted | 222/83 |
| 2,897,994 | 8/1959 | Foss | 220/4 |
| 3,010,598 | 11/1961 | Foss | 220/4 |
| 3,603,469 | 9/1971 | Magni | 215/6 |
| 3,924,741 | 12/1975 | Kachur | 366/130 |
| 4,022,205 | 5/1977 | Tenczar | 604/411 |
| 4,128,098 | 12/1978 | Bloom et al. | 128/272.3 |
| 4,152,378 | 5/1979 | Vcelka et al. | 261/121 R |

*Primary Examiner*—Robert W. Jenkins

*Attorney, Agent, or Firm*—Seidel, Gonda, Goldhammer & Abbott

[57] ABSTRACT

A mixing container and an adapter to interconnect the mixing container to a second container to permit intermixing of the contents of the containers. The mixing container has a neck with a plurality of raised circumferential ribs thereon. The adapter has a central cylindrical sleeve. A first end of the sleeve is surrounded by a cylindrical skirt. The interior surface of the first end of the sleeve has a plurality of circumferential grooves which enable the adapter to engage the ribs on the neck of the mixing container. The interior surface of the cylindrical skirt has a screw thread to enable the adapter to engage a conventional threaded container neck. The opposite, or second, end of the sleeve has a cutting sleeve therein, concentric with the sleeve. The cutting sleeve is adapted to pierce a seal on the mixing container. The second end of the sleeve frictionally engages the raised circumferential ribs on the mixing container during the mixing operation. The cutting sleeve and the central sleeve define a passage through the adapter to permit intermixing of the contents of the containers.

In a second embodiment of the invention, the mixing container and the adapter are keyed so that the seal on the mixing container can be broken only when the mixing container is at a particular angular orientation with respect to the adapter to avoid unintentionally breaking the seal.

15 Claims, 8 Drawing Figures

MIXING CONTAINER AND ADAPTER

BACKGROUND OF THE INVENTION

This invention is directed to containers adapted to be connected to one another in a manner which will permit the contents of the containers to be intermixed. In particular, this invention is directed to mixing containers with adapters to enable the contents of a first container to be mixed with the contents of a second container.

It is often desired to mix the contents of one container with the contents of a second container to prepare a mixture thereof. For example, in preparing pharmaceutical products or medicines to be administered in liquid form, it is often desired to mix a concentrated form of a medicine with water to prepare a dilute solution of the medicine suitable for administering to a patient. It is usually preferred to wait until the solution is needed before preparing the mixture. There is a need, therefore, for a mixing container and adapter that is quick and easy to use, and that permits reliable mixing.

The invention is also of value in any application where two ingredients need to be mixed just prior to dispensing.

SUMMARY OF THE INVENTION

The invention is a mixing apparatus comprising a container for containing a first ingredient to be mixed and an adapter for the container. The container has a neck terminating in an opening sealed by a frangible seal. The neck has means integral therewith and adjacent the opening for releasably securing the adapter to the container in a first position and a discretely separate second position. The adapter has cooperating first means integral therewith for releasably securing the adapter to the container in the first position and cooperating second means integral therewith for releasably securing the adapter to the container in the second position. The adapter includes means integral therewith for breaking the frangible seal when the adapter is in the second position and means integral with the adapter for preventing breaking of the frangible seal when the adapter is in the first position. The adapter also has means integral therewith for releasably securing the adapter to a second container for containing a second ingredient to be mixed when the adapter is in the second position. The adapter has a passage through which the first and second ingredients may flow for mixing when the adapter is in the second position.

In a first preferred embodiment of the invention, the invention comprises a mixing container for containing a first ingredient to be mixed and an adapter for the container. The container has an elongated neck terminating in an opening sealed by a frangible seal. The neck has means integral therewith and adjacent the opening for releasably securing the adapter to the container in a first position and a second position. The adapter comprises a central passage therethrough defined by a generally cylindrical outer sleeve. The adapter includes first means at one end of the sleeve for releasably securing the adapter to the container in the first position and cooperating second means at the opposite end of the sleeve for releasably securing the adapter to the container in the second position. The adapter has means adjacent said other end of the sleeve for breaking the frangible seal when the adapter is in the second position and means adjacent said one end of the sleeve for preventing breaking of the frangible seal when the adapter is in the first position. The adapter further includes means adjacent said one end of the sleeve for releasably securing the adapter to a second container for containing a second ingredient to be mixed with the first ingredient when the adapter is in the second position.

In a second preferred embodiment, the invention comprises a mixing container for containing a first ingredient to be mixed and an adapter for the container. The container has an elongated neck terminating in an opening sealed by a frangible seal. The neck has means integral therewith and adjacent the opening for releasably securing the adapter to the container in a first position and a second position. The adapter comprises a central passage therethrough defined by a generally cylindrical outer sleeve, and includes cooperating first means at one end of the sleeve for releasably securing the adapter to the container in the first position and cooperating second means within the sleeve for releasably securing the adapter to the container in the second position. Means are provided within the sleeve adjacent to said second means for breaking the frangible seal when the adapter is in the second position. The container further includes key means on the container neck for slideably engaging said one end of the sleeve to prevent breaking of the frangible seal when the adapter is in the first position. The adapter further includes a keyway in the sleeve for permitting the adapter to move from the first position to the second position when the key on the container neck is in alignment with the keyway in the sleeve. The adapter also includes means for releasably securing the adapter to a second container for containing a second ingredient to be mixed with the first ingredient when the adapter is in the second position.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE PREFERRED EMBODIMENTS

Figure 1:
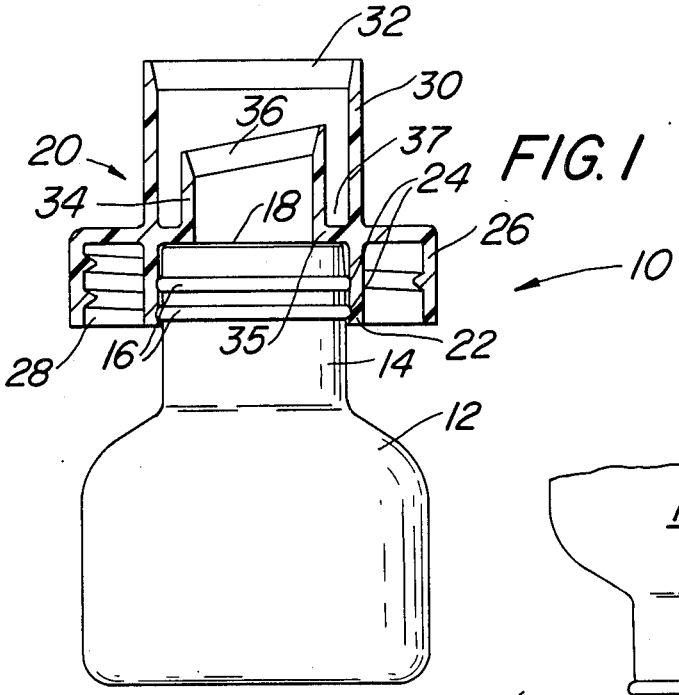
FIG. 1 illustrates a mixing container and adapter in accordance with one embodiment of the invention, showing the adapter in the first position.

Referring now to the drawings, wherein like numerals indicate like elements, there is shown in FIG. 1 a mixing container and adapter in accordance with the present invention, generally designated by the numeral 10. A container 12 contains a first ingredient to be mixed. For example, the container 12 may contain a medicine in powder or concentrated liquid form which is to be mixed with water prior to administering the medicine to a patient. Container 12 may be any suitable container, for instance a bottle. It should also be understood that the container 12 may be made of any suitable material, such as glass, polypropylene and the like. It should be further understood that, although the invention is applicable to mixing ingredients of any type, for purposes of explaining the invention it will be assumed that the container 12 contains a medicine to be mixed with water to prepare a solution for administering to a patient.

The mixing container and adapter 10 shown in FIG. 1 are illustrated as intended to be supplied to the user or purchaser of the medicine to be mixed. That is, the container 12 and adapter 20 are intended to be sold as a unit.

As shown in FIG. 1, container 12 has an elongated neck opening 14. A pair of raised circumferential ribs 16 are provided on neck 14 adjacent the opening. The opening of container 12 is sealed by a frangible seal 18, such as foil or other suitable material which can be applied to container 12 to form a hermetic seal.

Figure 2:
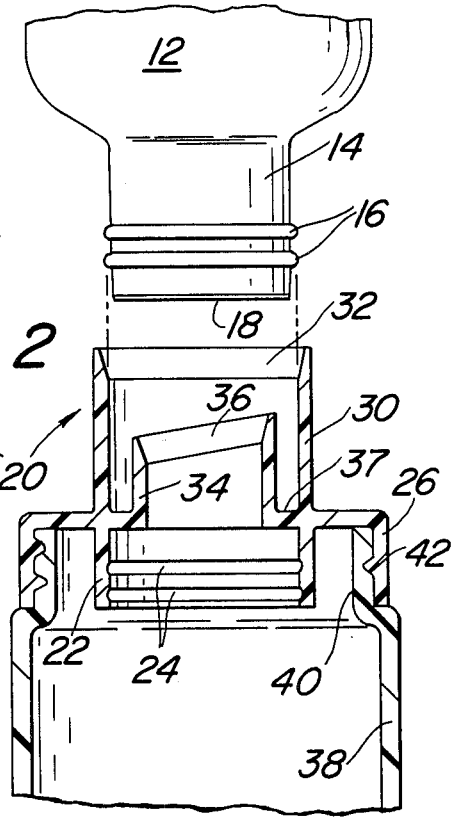
FIG. 2 illustrates the adapter of FIG. 1 releasably secured to a second container, with the mixing container shown prior to breaking the frangible seal.
Figure 3:
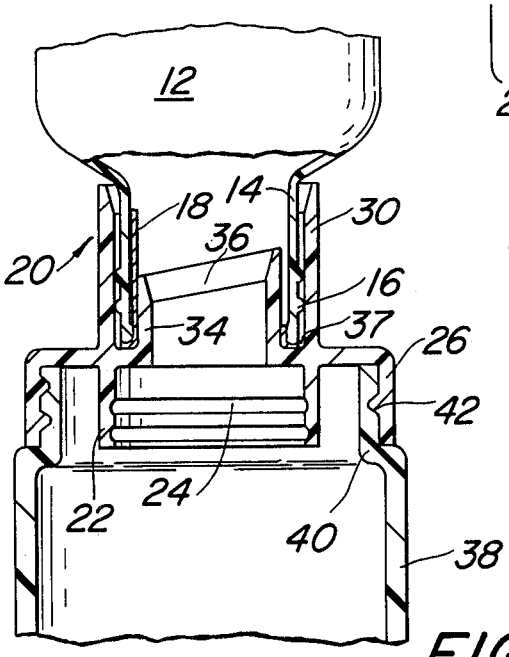
FIG. 3 illustrates the adapter in the second position on the mixing container and releasably secured to the second container.

Adapter 20 comprises a central cylindrical sleeve made up of lower sleeve portion 22 and upper sleeve portion 30. As best seen in FIGS. 2 and 3, the lower sleeve portion 22 is provided with a pair of circumferential grooves 24 which mate with raised circumferential ribs 16 on the neck of container 12 to enable the adapter 20 to be releasably secured to container 12. Adapter 20 can easily be snapped on or off of container 12 by means of the ribs 16 and grooves 24. Adapter 20 further includes a downwardlyopening cylindrical skirt 26 concentric with and surrounding lower sleeve portion 22. Skirt 26 has a larger diameter than lower sleeve portion 22, and is provided on its internal surface with a male screw thread 28. The purpose of male screw thread 28 will become clear hereinafter.

Upper sleeve portion 30 terminates in a beveled opening 32. Beveled opening 32 aids in the insertion of container neck 14 into upper sleeve portion 30, as will be explained more fully hereinbelow.

Concentric with and disposed within upper sleeve portion 30 is a generally cylindrical cutting sleeve 34. Cutting sleeve 34 has an angled tip 36 so that one side of cutting sleeve 34 is longer than the other. Cutting sleeve 34 is provided to pierce the frangible seal 18 on container 12, as will be described in greater detail below.

Adapter 20 is preferably molded in a single piece from polypropylene or other suitable material. It will be noticed that this molding technique provides an annular shoulder 35 and an annular groove 37 between upper sleeve portion 30 and cutting sleeve 34. The shoulder 35 rests on the extreme end of container neck 14 when the adapter 20 is snapped onto container 12 as shown in FIG. 1. This arrangement prevents the seal 18 from becoming accidentally broken before it is desired to release the contents of container 12. Thus, in the position shown in FIG. 1, the adapter 20 functions as a protective cap for container 12.

FIGS. 2 and 3 illustrate the way in which the adapter enables the contents of container 12 to be mixed with the contents of a second container. As already noted, it will be assumed for purposes of illustration that the second container is a bottle of water with which the contents of container 12 are to be mixed to form a medicine solution for administering to a patient. The way adapter 20 is used to facilitate mixing will now be described with reference to FIGS. 2 and 3.

Container 38 may be a standard sterile water bottle such as is commonly available for pharmaceutical applications. Container 38 has a neck 40 which has a female thread on its outer circumference. Container 38 typically is sealed only by a removable cap (not shown) which screws onto and off of container neck 40 by means of the thread 42.

To prepare a medicine solution, the user removes adapter 20 from container 12 by lifting it upward to release ribs 16 from grooves 24. Once the adapter 20 is removed from container 12, it is screwed onto container 38 by means of threads 28 in circumferential skirt 26. In this way, adapter 20 can be firmly but releasably secured to container 38. Once adapter 20 is secured to container 38, the user inverts container 12 and inserts it, neck first, into upper sleeve portion 30. As best shown in FIGS. 2 and 3, the inner diameter of upper sleeve portion 30 is only slightly greater than the outer diameter of container neck 14, and slightly less than the outer diameter of ribs 16. This permits container neck 14 to be easily inserted into upper sleeve portion 30 but yet be securely held within upper sleeve portion 30 by friction between ribs 16 and the inner wall of upper sleeve portion 30. This prevents container 12 from slipping during the mixing operation, and also provides a seal to prevent spillage.

As shown in FIG. 3, pushing the container neck 14 completely into upper sleeve portion 30 will cause the angled tip 36 of cutting sleeve 34 to pierce frangible seal 18 so that the contents of container 12 may be released into container 38 for mixing. As clearly shown in FIG. 3, once frangible seal 18 is broken, the ingredients of container 12 can move freely through cutting sleeve 34 and lower sleeve portion 22 into container 38. The annular groove 37 formed between upper sleeve portion 30 and cutting sleeve 34 acts as a stop to limit downward movement of container 12.

After container neck 14 has been fully inserted into outer sleeve 30, the two containers may be grasped and shaken manually, or by any other means, to facilitate mixing of the contents. To dispense the now-mixed contents, the user may remove container 12 and pour the contents out of container 38 through adapter 20, or may simply unscrew adapter 20 from container 38 and pour the contents of container 38 in conventional fashion.

Figure 4:
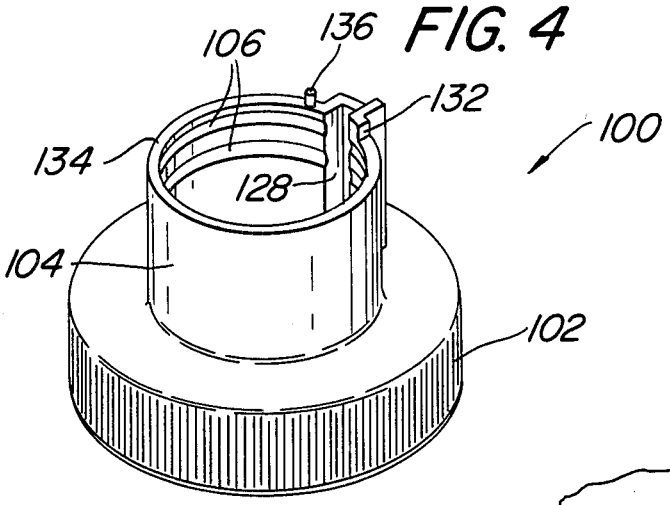
FIG. 4 is an isometric view of an adapter in accordance with a second embodiment of the invention.
Figure 5:
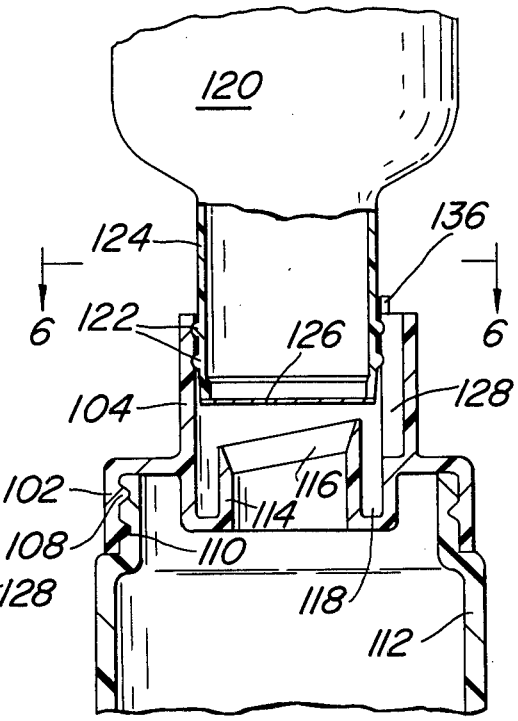
FIG. 5 illustrates the adapter of FIG. 4 in the first position on a mixing container, with the adapter releasably secured to a second container.

Referring now to FIGS. 4-8, there is shown a second embodiment of a mixing container and adapter in accordance with the present invention. The adapter 100 is quite similar to adapter 20. Adapter 100 has an upper sleeve portion 104 within which is disposed a cutting sleeve 114. Cutting sleeve 114 is concentric with and of lesser diameter than upper sleeve portion 104. Like cutting sleeve 34, cutting sleeve 114 has an angled tip 116 to facilitate piercing the frangible seal 126 on container 120. The inner surface of upper sleeve portion 104 has a pair of circumferential grooves 106 adjacent the extreme end thereof. Grooves 106 mate with raised circumferential ribs 122 on container neck 124 to releasably secure adapter 100 to container 120. Grooves 106 are located so that frangible seal 126 is spaced apart from cutting sleeve 114 when adapter 100 is snapped onto container 120 as shown in FIG. 5. Adapter 100 is provided with a longitudinal keyway 128, the purpose of which will become clear hereinafter.

Figure 6:
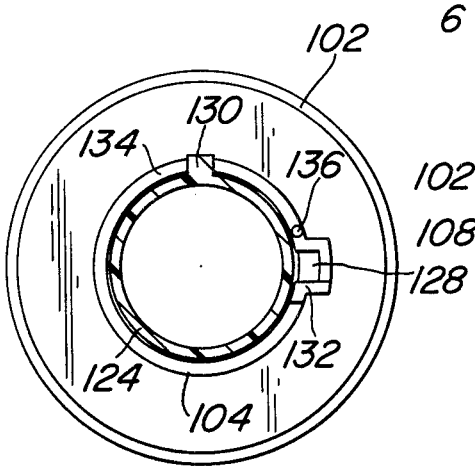
FIG. 6 is a sectional view taken along the lines 6—6 of FIG. 5, with the adapter in the first position.

It will be noticed so far that container 120 is identical to container 12. This is so except for provision of key 130 on container neck 124. Key 130 is provided so that, when the adapter 100 is snapped onto container neck 124 by means of ribs 122 and grooves 106, container 120 cannot inadvertently be pushed toward cutting sleeve 114 to break seal 126. As best seen in FIG. 6, key 130 rests on upper surface 134 of upper sleeve member 104 to limit movement of container 120 into upper sleeve portion 104. Container 120 can be pushed into upper sleeve portion 104 to break seal 126 only when key 130 is aligned with keyway 128 in adapter 100. As best seen in FIGS. 4 and 5, a fixed stop 132 is provided on one side of keyway 128 and a break-away detent 136 is provided on the opposite side of keyway 128. If container 120 is rotated counterclockwise with respect to adapter 100, key 130 will eventually strike limit stop 132, preventing further rotation of the container. However, clockwise rotation of container 120 will cause key 130 to eventually strike break-away detent 136. At that point, further rotation of the container will cause break-away detent 136 to shear, so that key 130 can be moved into alignment with keyway 128. Thus, a definite conscious act by the user is required to align the key 130 with key way 128. This arrangement thus minimizes the chance of accidentially pushing container 120 against cutting sleeve 114 before it is desired to break seal 126.

Figure 7:
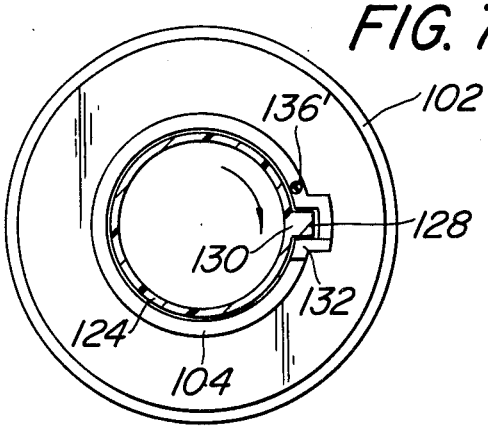
FIG. 7 is a sectional view taken along the lines 6—6 in FIG. 5 with the mixing container rotated 90° from FIG. 6.
Figure 8:
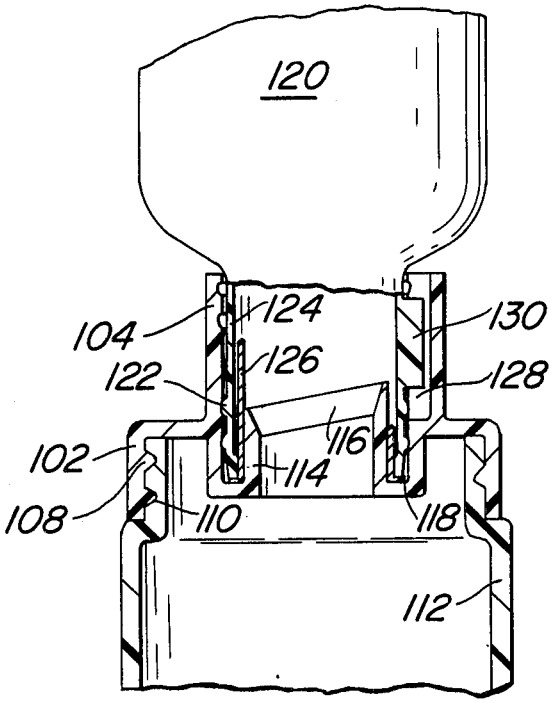
FIG. 8 is a sectional view of the adapter in the second position on the mixing container, with the adapter releasably secured to the second container.

Referring now to FIGS. 7 and 8, once key 130 is aligned with keyway 128, container 120 can be pushed down relative to adapter 100, causing cutting sleeve 114 to pierce seal 126 and allow the contents of container 120 to mix with the contents of container 112. Annular groove 118 acts as a stop to prevent further downward insertion of container 120. When container 120 has been fully inserted into adapter sleeve 104, ribs 122 frictionally engage the interior surface of upper sleeve portion 104 to provide a snug fit between container neck 124 and adapter 100, and to provide a seal to prevent spillage during mixing. Mixing is done in the same manner as with the first embodiment of the invention. After mixing is complete, the adapter 100 and container 120 may be removed from container 112 and the contents dispensed, or alternatively container 120 may be removed and the now-mixed contents of container 112 may be dispensed through the opening in cutting sleeve 114.

The mixing container and adapter of the present invention provide a novel and convenient apparatus for mixing and dispensing the contents of two containers just prior to use. In addition, the present invention provides a means of protecting the seal of the container from accidental breakage before it is desired to prepare the mixture. The adapter of the present invention is simple to use, can be easily made in one piece, can be made inexpensively so that the adapter may be discarded after use and permits simple and reliable mixing.

The present invention may be embodied in other specific forms without departing from the spirit or essential attributes thereof and, accordingly, reference should be made to the appended claims, rather than to the foregoing specification, as indicating the scope of the invention.

I claim:

1. Mixing apparatus comprising a container for containing a first ingredient to be mixed and an adapter for the container, the container having a neck terminating in an opening sealed by a frangible seal, the neck having means integral therewith and adjacent the opening for releasably securing the adapter to the container in a first position and a second position, the second position being discretely separate from the first position, the adapter having cooperating first means integral therewith for releasably securing the adapter to the container in the first position and cooperating second means integral therewith for releasably securing the adapter to the container in the second positibn, the adapter further having means integral therewith for breaking the frangible seal when the adapter is in the second position and means integral therewith for preventing breaking of the frangible seal when the adapter is in the first position, the adapter also having means integral therewith for releasably securing the adapter to a second container for containing a second ingredient to be mixed when the adapter is in the second position, and the adapter having a passage through which the first and second ingredients may flow for mixing when the adapter is in the second position.

2. A mixing container for containing a first ingredient to be mixed and an adapter for the container, the container having an elongated neck terminating in an opening sealed by a frangible seal, the neck having means integral therewith and adjacent the opening for releasably securing the adapter to the container in a first position and a second position, the second position being discretely separate from the first position, the adapter comprising a central passage therethrough defined by a generally cylindrical outer sleeve, cooperating first means at one end of the outer sleeve for releasably securing the adapter to the container in the first position, cooperating second means within the outer sleeve for releasably securing the adapter to the container in the second position, means within the outer sleeve and adjacent to said second means for breaking the frangible seal when the adapter is in the second position, the container further including a key means on the container neck for slideably engaging said one end of the outer sleeve for preventing breaking of the frangible seal when the adapter is in the first position, and the adapter further including a keyway in said sleeve for permitting the adapter to move from the first position to the second position when the key on the container neck is in alignment with the keyway in the outer sleeve, the adapter also including means for releasably securing the adapter to a second container for containing a second ingredient to be mixed with the first ingredient when the adapter is in the second position.

3. Apparatus according to claim 2, wherein the frangible seal comprises a metal foil.

4. Apparatus according to claim 2, wherein the container neck is substantially cylindrical and the means integral therewith for releasably securing the adapter to the container includes at least one raised projection on the circumference of the neck.

5. Apparatus according to claim 4, wherein said cooperating first means on the adapter comprises at least one depression adapted to receive said at least one projection.

6. Apparatus according to claim 2, wherein the means for breaking the frangible seal comprises a generally cylindrical inner sleeve within and concentric with said generally cylindrical outer sleeve, the diameter of the inner sleeve being less than the diameter of the outer sleeve.

7. Apparatus according to claim 6, wherein the end of the inner sleeve which breaks the frangible seal is truncated at an acute angle to the axis of the inner sleeve.

8. Apparatus according to claim 2, wherein the means for releasably securing the adapter to the second container comprises a threaded skirt concentric with and surrounding the outer sleeve.

9. A mixing container for containing a first ingredient to be mixed and an adapter for the container, the container having an elongated neck terminating in an opening sealed by a frangible seal, the neck having means integral therewith and adjacent the opening for releaseably securing the adapter to the container in a first position and a second position, the second position being discretely separate from the first position, the adapter comprising a central body portion having a passageway therethrough the internal surface of one end of said passageway being provided with first means for releaseably securing the adapter to the container in the first position and the internal surface of the other end of said passageway being provided with second means for releaseably securing the adapter to the container in the second position; means adjacent, and internally disposed with respect to, said other end of said passageway for breaking the frangible seal when the adapter is in the second position, means intermediate said ends of said passageway for preventing breaking of the frangible seal when the adapter is in the first position, and means adjacent and externally disposed with respect to said passageway for releaseaby securing the adapter to a second container for containing a second ingredient to be mixed with the first ingredient when the adapter is in the second position.

10. Apparatus according to claim 9, wherein the frangible seal comprises a metal foil.

11. Apparatus according to claim 9, wherein the container neck is substantially cylindrical and the means integral therewith for releasably securing the adapter to the container include at least one raised projection on the circumference of the neck.

12. Apparatus according to claim 11, wherein said cooperating first means on the adapter comprises at least one depression adapted to receive said raised projection.

13. Apparatus according to claim 9, wherein said central body portion is of cylindrical configuration and the means for breaking the frangible seal comprises a generally cylindrical inner sleeve concentric with said central body portion, the diameter of the inner sleeve being less than the diameter of said central body portion.

14. Apparatus according to claim 13, wherein the end of the inner sleeve which breaks the frangible seal is truncated at an acute angle to the axis of the inner sleeve.

15. Apparatus according to claim 13, wherein the means for releasably securing the adapter to the second container comprises a threaded skirt concentric with and surrounding said one end of said central body portion.

* * * * *